US009617064B2

(12) United States Patent
Rohrschneider et al.

(10) Patent No.: US 9,617,064 B2
(45) Date of Patent: Apr. 11, 2017

(54) SPRAY HEAD FOR AN AEROSOL TANK

(75) Inventors: Marc Rohrschneider, Hagen (DE); Waldemar Masur, Altenberge (DE); Elvira Piel, Dortmund (DE); Campbell Patrick, Bad Oldesloe (DE); Rüdiger Belau, Bad Oldesloe (DE); Karl-Heinz Lange, Buende (DE)

(73) Assignee: Boehringer Ingelheim microParts GmbH, Dortmund (DE)

( * ) Notice: Subject to any disclaimer, the term of this patent is extended or adjusted under 35 U.S.C. 154(b) by 2262 days.

(21) Appl. No.: 10/943,165

(22) Filed: Sep. 17, 2004

(65) Prior Publication Data

US 2005/0103892 A1 May 19, 2005

(30) Foreign Application Priority Data

Sep. 18, 2003 (DE) ..... 103 43 672

(51) Int. Cl.

*B65D 83/20* (2006.01)
*B65D 83/14* (2006.01)
*B65D 83/16* (2006.01)

(52) U.S. Cl.

CPC ..... *B65D 83/20* (2013.01); *B65D 83/753* (2013.01); *B65D 83/16* (2013.01)

(58) Field of Classification Search

CPC ..... B65D 83/14; B65D 83/16; B65D 83/20; B65D 83/201; B65D 83/205; B65D 83/753

USPC ..... 239/589, 86, 336–339, 340, 344, 354; 222/402.1–402.13

See application file for complete search history.

(56) References Cited

U.S. PATENT DOCUMENTS

| | | | | |
|---|---|---|---|---|
| 2,592,208 | A | 4/1952 | Stamper | |
| 2,592,808 | A * | 4/1952 | Knapp | 251/321 |
| 2,941,728 | A * | 6/1960 | Paldanius | 239/284.1 |
| 3,848,778 | A | 11/1974 | Meshberg | |
| 3,913,842 | A * | 10/1975 | Singer | 239/337 |
| 3,967,760 | A * | 7/1976 | Marcon | 222/153.11 |
| 4,354,638 | A | 10/1982 | Weinstein | |
| 5,388,730 | A | 2/1995 | Abbott et al. | |
| 5,467,902 | A * | 11/1995 | Yquel | 222/402.1 |
| 5,480,095 | A * | 1/1996 | Stevenson et al. | 239/104 |
| 5,711,484 | A * | 1/1998 | Blette et al. | 239/104 |
| 5,732,855 | A * | 3/1998 | van der Heijden | 222/402.12 |
| 6,173,907 | B1 * | 1/2001 | Benoist | 239/337 |
| 6,265,025 | B1 * | 7/2001 | DePaoli et al. | 427/213.3 |

(Continued)

FOREIGN PATENT DOCUMENTS

| | | |
|---|---|---|
| DE | 9103135 | 7/1991 |
| DE | 201 16 336 U1 | 1/2002 |

(Continued)

*Primary Examiner* — Christopher Kim
(74) *Attorney, Agent, or Firm* — David S. Safran

(57) ABSTRACT

A spray head for an aerosol tank, and an aerosol tank having a spray head is provided, which includes a fluid exit valve for spraying a low-solvent fluid. The fluid exit valve of the aerosol tank defines an axial fluid exit direction. The spray head includes a capillary tube for routing the fluid and for nozzle-less spraying of the fluid. An entry end of the capillary tube is axially joined to the fluid exit valve when the spray head has been seated on the aerosol tank. An exit end of the capillary tube is open to the ambient atmosphere. In the spray head, the capillary tube runs from the entry end to the exit end in an arc of approximately 90°.

9 Claims, 7 Drawing Sheets

(56) References Cited

U.S. PATENT DOCUMENTS

| | | | |
|---|---|---|---|
| 2002/0060255 | A1 | 5/2002 | Benoist |
| 2003/0150937 | A1 | 8/2003 | Laidler et al. |

FOREIGN PATENT DOCUMENTS

| | | | |
|---|---|---|---|
| EP | 0 409 497 | A1 | 1/1991 |
| FR | 1594378 | | 7/1970 |
| GB | 1163573 | | 9/1969 |
| JP | 2002-233797 | | 8/2002 |
| WO | WO 02/48004 | A1 | 6/2002 |
| WO | WO 03/051522 | A2 | 6/2003 |

* cited by examiner

SPRAY HEAD FOR AN AEROSOL TANK

BACKGROUND OF THE INVENTION

Field of the Invention

The invention relates to a spray head with a capillary tube for seating on an aerosol tank.

Description of Related Art

A known spray head is shown in WO 03/051522 A2 (Published U.S. patent application 2003150885) which has the peculiarity that spraying of the fluid takes place without a nozzle. The fluid is introduced under high pressure into a capillary tube with a very small diameter and routed to an exit end from which it is sprayed without a nozzle. What is important is that the use of a capillary tube for this form of spraying of a liquid leads to the liquid being able to be sprayed even with little solvent and thus "dry" in a subjective perception. This novel spraying of low-solvent liquid is called "LoFlo". It is characteristic not only that the liquid which is being sprayed is sprayed with little solvent, but that the spraying can take place even with a comparatively low propellant gas portion. Volumes and volumetric ratios in the capillary system are discussed in published U.S. patent application 2003150885. Extensive examples for all possible types of liquids which can be sprayed with this system are also cited in this reference. Also, the capillary tube extends from the entry end to the exit end which corresponds to the conventional alignment of a capillary tube. Metal tubes, plastic tubes or glass tubes can be used as the capillary tube.

Spray heads for aerosol tanks have been known for decades in a host of embodiments, such as disclosed in European patent application 0 409 497 and U.S. Pat. Nos. 5,388,730 and 3,848,778. In conventional spray heads, there is a tube which does not act as a capillary tube for transport of the liquid which is to be sprayed in the spray head. On the end of this tube there is a spray nozzle which causes the type and manner of spraying of the liquid. The pressure builds up for spraying the liquid at the nozzle, retroactively therefore in the tube. The fluid-dynamic relationships here are of a completely different type from in a spray head with a capillary tube for nozzle-less spraying of the fluid as in the present invention.

In conventional spray heads, millions of which are used for aerosol tanks, it is certainly important that the exit direction of the fluid for spraying lies essentially at a right angle to the axial fluid exit direction which is defined by the conventional female or male fluid exit valve on the aerosol tank. This relates to handling. The operator holds the fluid container (can) of the aerosol tank encompassed with three fingers and the thumb and presses with the index finger from overhead on the spray head in order to actuate the fluid exit valve of the aerosol tank. It is usually a normal seat valve or stem valve which has likewise been known for decades in a host of versions. Pressing down the spray head by finger pressure from overhead to open the fluid exit valve makes axial fluid emergence impossible and imposes fluid emergence which is directly essentially at a right angle thereto.

In the known conventional spray heads, aerosol tanks with conventional fluid exit valves are used. Conventional fluid exit valves for aerosol tanks have a valve body which is spring-loaded, to the top and which can be pressed down into the open position against the preliminary tension by the valve spring. This takes place for a female fluid exit valve by the valve tappet of the spray head, which tappet enters the receiving mount on the top end of the valve support. In a male fluid exit valve, a valve tappet which projects up is part of the valve body. The spray head has a corresponding receiver for this valve tappet. Pressing down the valve tappet opens the fluid exit valve.

A spray head is known for an aerosol tank with an atypical fluid exit valve as shown in U.S. Pat. No. 2,592,808. In this design, the fluid exit valve is part of the spray head. This spray head itself has an immersion tube which extends down into the fluid container and in which a capillary tube runs far into the fluid container. The capillary tube itself, together with a slip-in guide, constitutes the fluid exit valve. In the spray head, the capillary tube runs from the entry end to the exit end in an arc of roughly 90°, the course of the arc being ensured by interfitting outside and inside guides. This construction is not altogether suited for aerosol tanks with conventional fluid exit valves.

SUMMARY OF THE INVENTION

One object of the present invention is to improve upon and further develop the conventional spray head with a capillary tube for an aerosol tank with a conventional fluid exit valve such that the typical actuation of the conventional spray head can also achieved.

The above object and other objects are achieved by providing a spray head for an aerosol tank which is closed by a fluid exit valve including one of a female fluid exit valve and a male fluid exit valve, used for spraying a fluid from the aerosol tank, the fluid exit valve defining an axial fluid exit direction, the spray head comprising a capillary tube for routing the fluid and for nozzle-less spraying of the fluid. The capillary tube includes an entry end and an exit end wherein the entry end of the capillary tube is arranged to be axially joined to the fluid exit valve when the spray head is seated on the aerosol tank. The exit end of the capillary tube is open to ambient atmosphere. The capillary tube running approximately in an arc of approximately 90° from the entry end to the exit end in the spray head. The spray head also including at least one of a valve tappet for receiving the capillary tube and for connecting to the female fluid exit valve, and a receiver for receiving a valve tappet of the male fluid exit valve, said capillary tube extending into said receiver.

It is important that the spray head itself makes available a guide to force the capillary tube, which has an elongated straight shape, into the necessary arc for implementing the correct alignment of the exit end of the capillary tube. The spray head is an independent component which, for a conventional female fluid exit valve, ends in a valve tappet into which the capillary tube extends. A conventional male fluid exit valve ends in a receiver into which the capillary tube extends.

The inside diameter of the capillary tube may be between approximately 0.1 mm and approximately 2.0 mm and a length of the capillary tube may be approximately 10 mm to approximately 100 mm. Preferably, the inside diameter is between approximately 0.2 mm and approximately 1.0 mm and the length of the capillary tube is approximately 25 mm to approximately 50 mm.

The capillary tube may be held on the entry end and on the exit end in the spray head, the arc of said capillary tube being exposed in between the entry end and the exit end. The spray head may include at least one of an outside guide and an inside guide corresponding to a desired course of the arc of the capillary tube so that the arc of the capillary tube is guided adjacently to the outside guide and the inside guide.

This configuration ensures closed guidance of the capillary tube in any case on the inside or on the outside acquires special importance.

Preferably, the capillary tube is made in one piece.

The present invention is also directed to an aerosol tank with a fluid container and a fluid exit valve attached to the fluid container on the top for closing the container, and with the spray head of the present invention mounted on the fluid container.

Furthermore, the teaching and its preferred embodiments and developments are further explained and described below in conjunction with the explanation of preferred embodiments using the drawings.

DETAILED DESCRIPTION OF THE INVENTION

Figure 1:
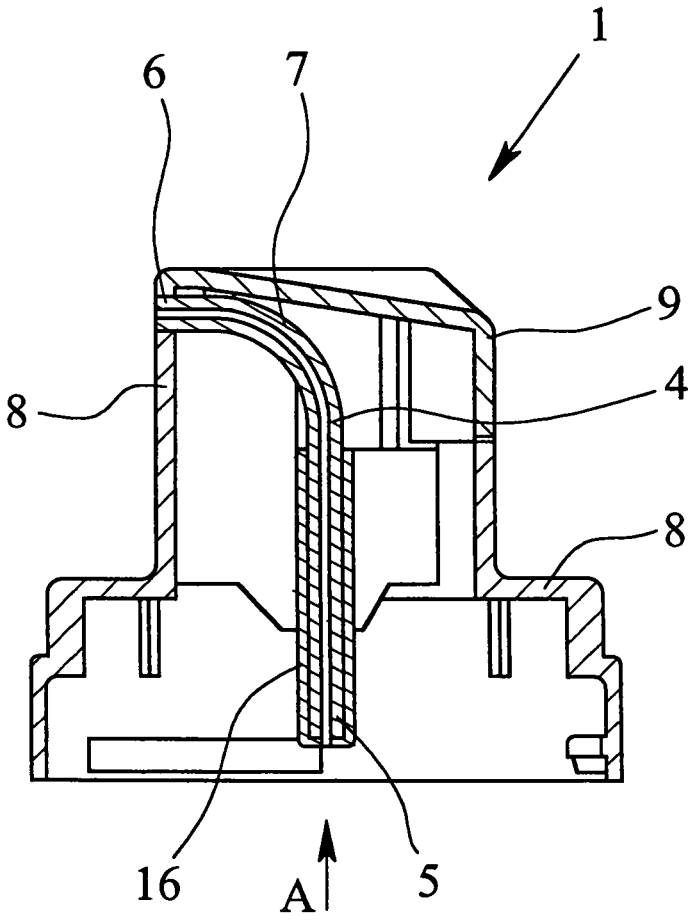
FIG. 1 shows a cross sectional view of a first embodiment of a spray head of the present invention for a female fluid exit valve on an aerosol tank.

The spray head 1 of the present invention, as shown in FIG. 1 in a first embodiment, is designed and suited to be seated on an aerosol tank. Such a spray head is also shown, for example, in FIG. 3.

The aerosol tank has a fluid exit valve 3 which defines the axial fluid exit direction A. A conventional fluid exit valve 3 is provided either in the form of a conventional female fluid exit valve 3 with a receiver for the valve tappet, which is then located on the spray head 1, or a male fluid exit valve 3 with a valve tappet to which a receiver on the spray head is assigned. Reference should be made to the prior art for conventional features, such as published U.S. patent application 2003150885 and U.S. Pat. No. 3,848,778 for a conventional male fluid exit valve 3, and German utility application 201 16 335 for a conventional female fluid exit valve. The entire disclosures of published U.S. patent application 2003150885 and U.S. Pat. No. 3,848,778 are hereby incorporated by reference.

The spray head of the present invention is used for spraying a liquid, preferably a low-solvent liquid, and uses a capillary tube 4 for routing and for nozzle-less spraying of the liquid. The entry end 5 of the capillary tube 4 is axially joined to the fluid exit valve 3 when the spray head 1 has been seated on the aerosol tank 2. By pressing the spray head 1 down against the aerosol tank 2, the fluid exit valve 3 is opened and fluid under high pressure enters the capillary tube 4 on its entry end 5, then flows with low pressure (the pressure drop upon entry is considerable) in the capillary tube 4. In the capillary tube, the flow builds up a corresponding flow behavior and finally emerges on the exit end 6 of the capillary tube 4 as a spray jet of finally distributed droplets of selected drop size and size distribution. In particular, reference should be made to published U.S. patent application 2003150885 for the explanation of the phenomenon which occurs here.

It is now important for the present invention that the capillary tube 4 is arranged to run in the spray head 1 from the entry end 5 to the exit end 5 in an arc 7, preferably in an arc of roughly 90°. In the embodiment of FIG. 1, it is therefore such that the arc 7 of the capillary tube 4 is generally approximately 90°, including exactly 90° as shown, and, in the embodiment from FIG. 3, roughly less than 90°. The spray head 1 makes available the means for forcing the capillary tube 4 into this arc 7 which otherwise by itself has or would like to assume an extended, straight shape.

The arc shape of the capillary tube 4 in the spray head 1 can be implemented in various ways. This is detailed in the individual embodiments of the present invention.

First of all, for the material of the spray head 1, preferably a plastic material, will be chosen. Furthermore, it should be recommended that the capillary tube 4 be produced from a material which can be guided in an arc 7, for example, from metal, or preferably and thus also as primarily intended here, from plastic. It should be considered what was explained initially for the pressure drop upstream of the capillary tube 4. In the capillary tube 4 itself, an unduly high pressure no longer prevails, so that a version of the capillary tube 4 of plastic is easily possible in practice.

For the inside diameter of the capillary tube 4, dimensions between roughly 0.1 mm and roughly 2.0 mm, preferably roughly 0.2 mm and roughly 1.0 mm, are desirable. The length of the capillary tube 4 has a certain relationship to the inside diameter of the capillary tube 4 and should be roughly 10 mm to roughly 100 mm, preferably roughly 25 mm to roughly 50 mm. A length of the capillary tube 4 from roughly 30 mm to roughly 40 mm is typical for the course in a conventional spray head.

Referring to FIG. 1, the system, which is intended for a spray head 1 for a female fluid exit valve 3 on the aerosol tank 2, includes a lower part 8 which can be locked onto the suggested aerosol tank 2, a top part 9 which can move to a limited degree against the latter and which is locked onto the bottom part 8 of the spray head 1, and a capillary tube 4 which is held at the top on the entry end 5 in the bottom part 8 over a considerable distance, and held on the exit end 6 between the bottom part 8 and the top part 9 of the spray head 1, but is exposed in between in the arc 7. In fact, by locking the top part 9 onto the bottom part 8, the capillary tube 4 in the embodiment shown in FIG. 1 is moved on the exit end 6 into its holding position and is fixed there.

The two parts of the spray head 1 consist of plastic and are clipped to one another, as already explained.

Figure 2:
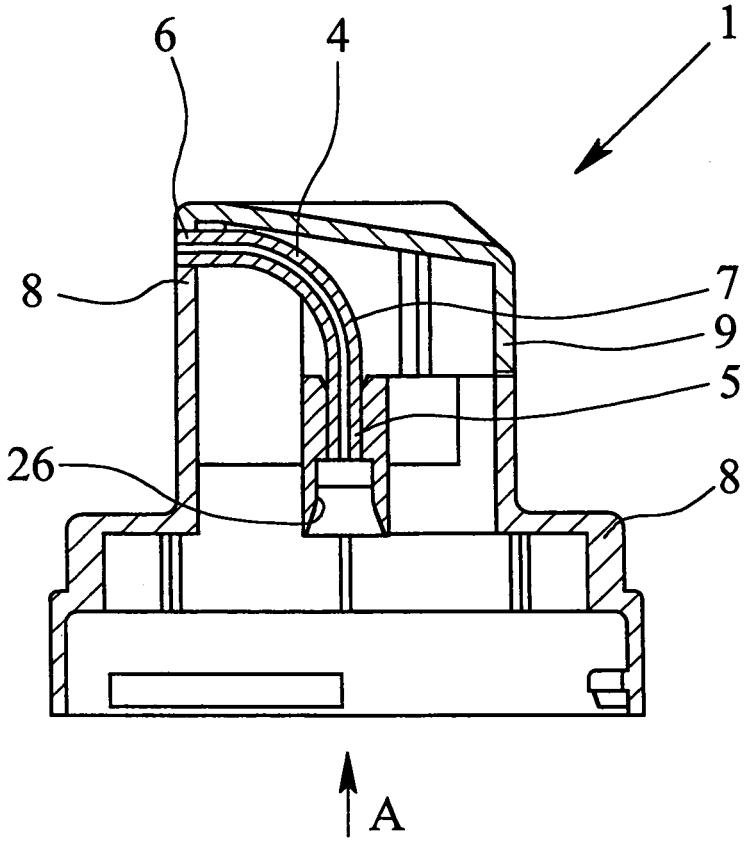
FIG. 2 shows another embodiment of a spray head of the present invention for a male fluid exit valve.

The embodiment illustrated in FIG. 2 shows the same basic construction as FIG. 1, with the same parts. The difference is solely that the capillary tube 4 here is located in a spray head 1 for a male fluid exit valve 3 with a stem valve which projects up.

Figure 3:
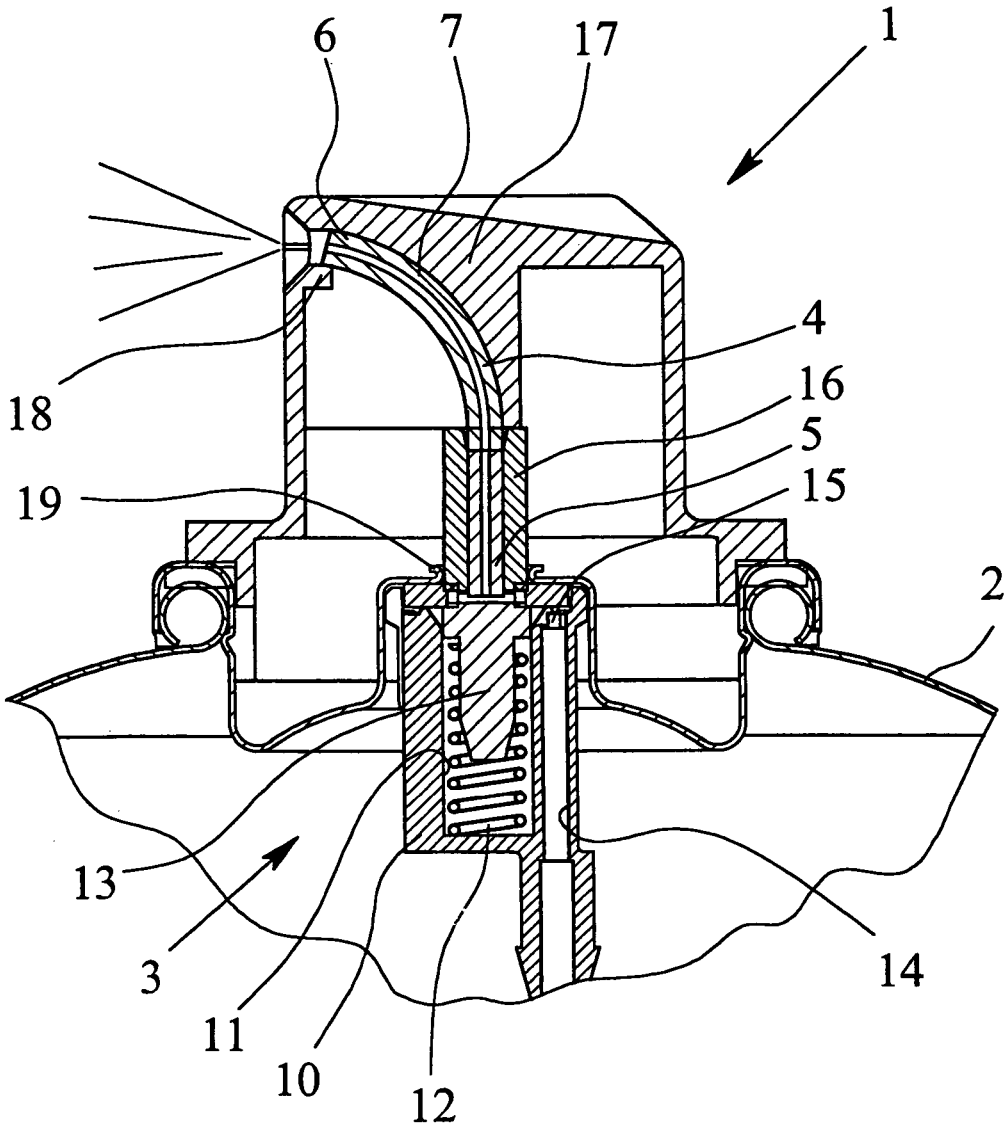
FIG. 3 shows another embodiment of a spray head of the present invention for a female fluid exit valve, at the same time with the aerosol tank indicated.

FIG. 3 shows a somewhat differently made version which suggests the spray head 1 mounted on the aerosol tank 2. Moreover, details of the female fluid exit valve 3 shown here can be recognized here. A valve support 10 with a valve chamber 11 and a valve spring 12 which is located on it and which presses the valve body 13 in FIG. 3 up into the closed position is apparent. To the right on the valve support 10, there is a lifting tube 14 which, for example, can dip into the liquid reserve in the aerosol tank 2, for example, via an immersion tube (not shown) which can be connected there. On the top end of the lifting tube 14, there is a passage 15 which can be joined to the entry end 5 of the capillary tube 4 when the valve body 13 is pressed somewhat down. The capillary tube 4 itself is located with its entry end 5 in a valve tappet 16 which in this embodiment is part of the spray head 1. When the spray head 1 is seated on the aerosol tank 2, the valve tappet 16 is coupled to the valve support 10.

The embodiment shown here is characterized in that the spray head 1 has an outside guide 17 which corresponds to the desired course of the arc of the capillary tube 4 and that the arc 7 of the capillary tube 4 is guided adjacently to the outside guide 17.

At the top on the spray head 1 on the left is a holding device 18 which the exit end 6 of the capillary tube 4 enters and is fixed there. Otherwise the arc 7 of the capillary tube 4 is defined by the outer guide 17 which is dictated by the spray head 1 itself. The spray head 1 is made in one piece from plastic and is permanently joined to the valve tappet 16. If the spray head 1 is pressed altogether down against the aerosol tank 2, the fluid exit valve 3 opens and the fluid is sprayed via the capillary tube 4. The outside guide 17 in the spray head 1 guides and bends the capillary tube 4 into its desired arc-shaped alignment, while the spray head 1 is seated on the aerosol tank 2 and the valve tappet 16 is inserted into the receiving mount 19 on the top end of the valve support 10.

It is also especially feasible for the spray head 1 to have an inside guide 20 which corresponds to the desired course of the arc of the capillary tube 4. The arc 7 of the capillary tube 4 is guided adjacently to the inside guide 20. This design also leads to controlled, arc-shaped guidance of the capillary tube 4 which thus does not kink, for example, near the entry end 5 or the exit end 6 in an uncontrolled manner, as kinking would ruin operation.

Figure 4:
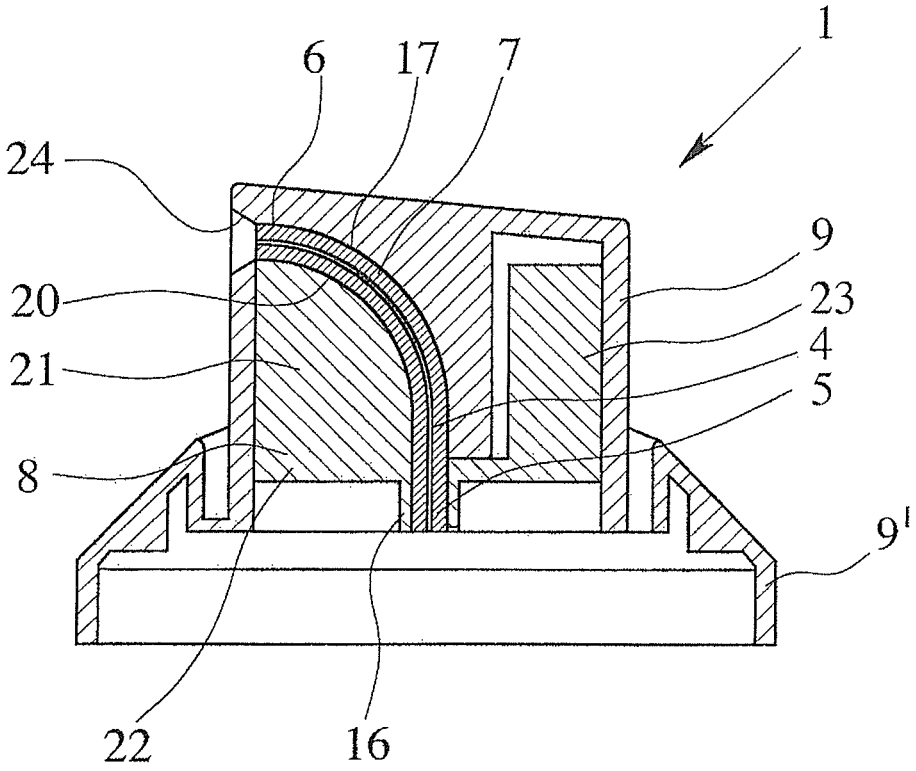
FIG. 4 shows a cross sectional view of a two-part spray head of the present invention.

In FIG. 4, the spray head 1 forms an outside guide 17 and an inside guide 20.

The drawings do not show one alternative which is characterized in that the outside guide 17 and the inside guide 20 are connected to one another into a closed channel and the capillary tube 4 is inserted into the channel. This threading of the capillary tube 4 which should consist in this respect preferably of plastic, is of course complex in terms of production engineering and is therefore done only in exceptional cases.

The embodiment shown in FIG. 4 shows another version which likewise leads to an outside guide 17 and an inside guide 20 for the capillary tube 4. The spray head 1 is made in two parts and on the top part 9 has an outside guide 17 and, on the bottom part 8, an inside guide 20. FIG. 4 shows the assembled spray head 1 of such an embodiment with the capillary tube 4 which is located on it. The trough-like inside guide 20 is apparent on the quadrant-shaped rib 21 which is molded on a disk-like base plate 22 which again bears the valve tappet 16 on the bottom. FIG. 4 shows the assembly including a guide rib 23. The entire spray head 1 consists of plastic for both parts 8, 9. In the top part 9, an exit opening 24 is apparent, from which the fluid flow which has been atomized from the exit end 6 of the capillary tube 4 can emerge undisturbed. Furthermore, it is apparent that here the top part 9 is made in one piece with the base part 9' which is seated on the edge of the aerosol tank 2.

Figure 5:
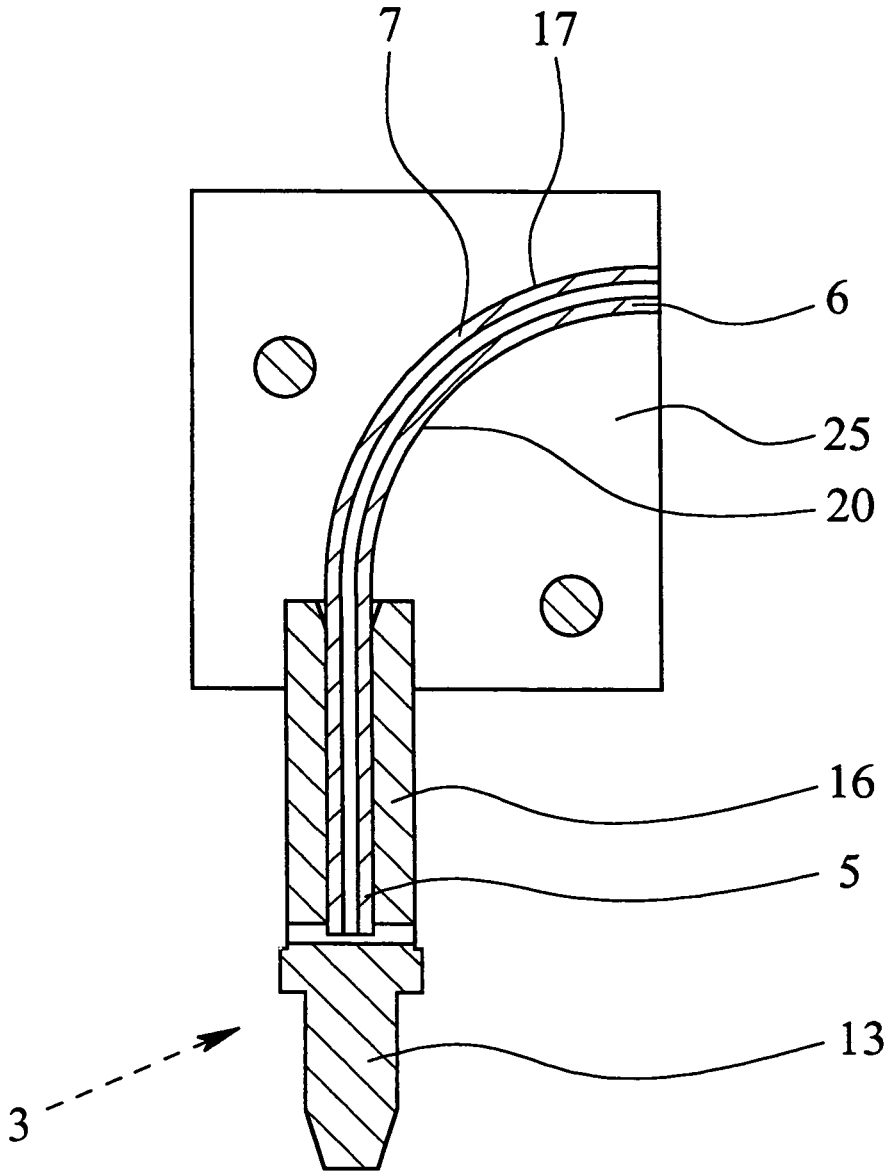
FIG. 5 shows a schematic view of another embodiment of a spray head of the present invention.
Figure 6:
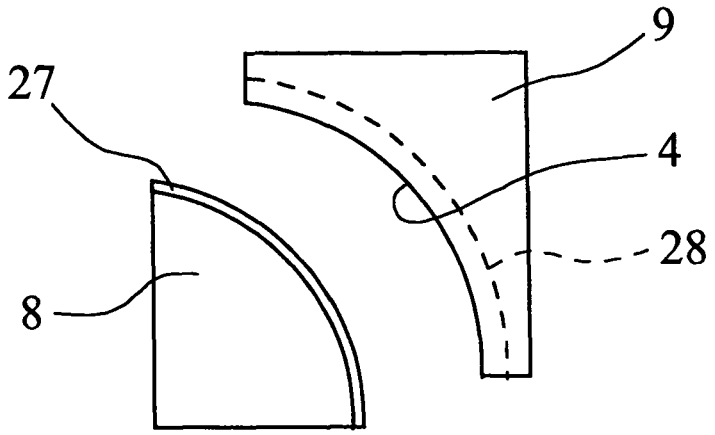
FIG. 6 shows an exploded view of another embodiment of a spray head of the present invention with an integrated capillary tube which is formed by the spray head itself.
Figure 7:
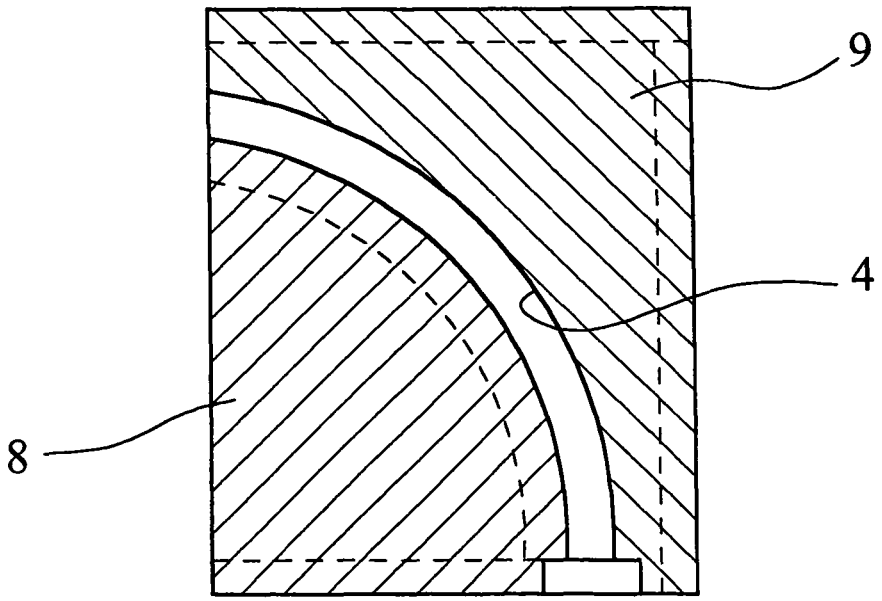
FIG. 7 shows the spray head of FIG. 6 in an assembled view.

The embodiment shown in FIG. 5 accomplishes the capillary tube 4 guided in an arc shape in a completely different way than the above explained embodiments. In the embodiment of FIG. 5, it is provided that the spray head 1 is made in two parts and the two parts 25 are made in the manner of a half-shell and are joined to one another for common formation of the outside guide 17 and the inside guide 20. The spray head 1 is assembled sideways in the manner of a half shell to form the necessary arc guidance for the capillary tube 4.

Both for the parts 8, 9 (bottom part/top part) and also the parts 25, the connection of the parts can be accomplished in different ways, for example by cementing, clipping, welding, locking, screwing, mortising, or some other technically efficient manner. The parts 8, 9 of the embodiment from FIG. 4 are locked. The parts 25 of the embodiment from FIG. 5 are mortised to one another, as is apparent from FIG. 5.

In terms of production engineering, the parts 8, 9, but certainly also the parts 25 of the spray head 1, if it is made of plastic, can be joined to one another via a hinge, especially a film hinge, and especially can be produced as one piece, therefore in one-piece molding.

The embodiment illustrated in FIG. 3 shows that the capillary tube 4 is made in several parts. Specifically, the part of the capillary tube 4 which is located in the valve tappet 16 is separated from the part of the capillary tube 4 which is guided in an arc shape in the arc 7. But here a one-piece execution of the capillary tube 4 is especially preferred. In any case, the capillary tube 4 extends, in one piece or several pieces, as far as the lower edge of the valve tappet 16 which is part of the spray head 1. In this way, a direct transition from the fluid exit valve 3 into the capillary tube 4 is ensured.

Conversely FIG. 2 shows a version which is characterized in that the spray head 1 has a receiver 26 for the valve tappet 16 of a male fluid exit valve 3 and the capillary tube 4 extends as far as and into the receiver 26. The male fluid exit valve 3 has a valve tappet which projects to the top and which is not shown in the drawings. This is a typical configuration of an aerosol tank 2. With this configuration, the spray head 1 can be attached altogether if necessary even to the aerosol tank 2 by specifically the receiver 26 of the spray head 1 being slipped onto the upwardly projecting valve tappet of the fluid exit valve 3 of the aerosol tank 2. This spray head 1 can be quickly removed from the fluid exit valve 3 of the aerosol tank 2 and, for example, can be replaced by another spray head 1 which may have a capillary tube 4 with a different inside diameter. With respect to this interchangeability, this is more feasible than mounting the spray head 1 itself on the aerosol tank 2 directly.

Figure 8:
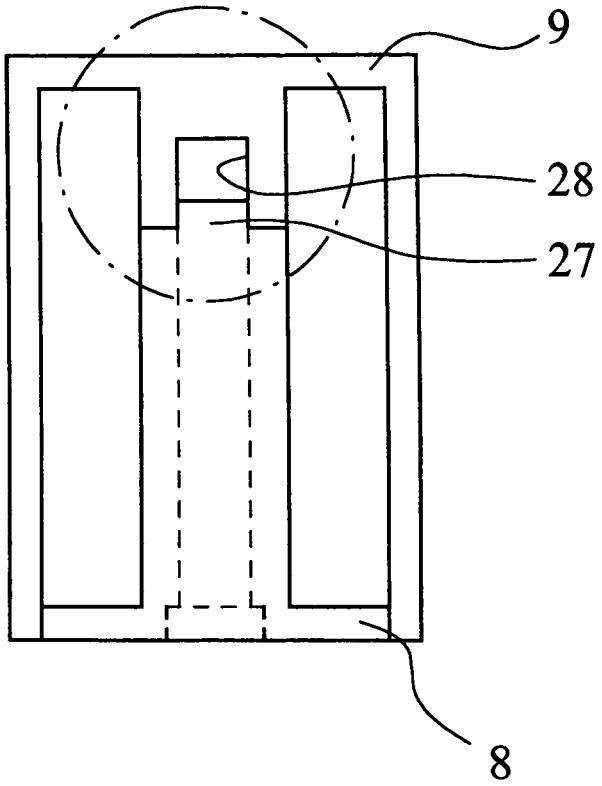
FIG. 8 shows a view of the spray head of FIG. 7 from the left in FIG. 7.
Figure 9:
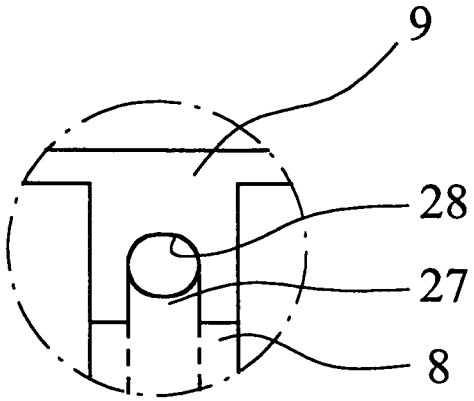
FIG. 9 shows an extract of FIG. 8 with another view of the integrally formed capillary tube.

Another alternative which is not shown in the drawings is characterized in that the spray head 1 in any case is made in one piece in the area of the capillary tube 4 and the capillary tube 4 is formed integrally as an arc-shaped channel. In this way, the capillary tube 4 is an integral component of the spray head 1, therefore need not be provided as a separate part. FIGS. 6 to 9 show an embodiment which adopts a modified version of the aforementioned design. Specifically, the spray head 1 is made in several parts, preferably in two parts, and the capillary tube 4 is formed integrally in the spray head 1 by interlocking formations 27, 28 of the parts 8, 9, which formations fit into one another to form a seal. The interlocking formation 27 on the bottom part 8 is an interlocking rib while the interlocking formation 28 on the top part 9, as shown in FIG. 8 in a section, is an interlocking groove. When the fit of the two is relatively narrow, the capillary tube 4 is located in between quite by itself. FIG. 8 shows a capillary tube 4 which is square in cross section while FIG. 9 shows a version which leads to a capillary tube 4 which is altogether circular in cross section. This can be accomplished especially efficiently with a spray head 1 which is made of plastic.

The subject matter of the invention is also an aerosol tank 2 which has a conventional fluid container 2 with a conventional male or female fluid exit valve 3 which is attached to the fluid container 2 on the top and which seals it. A spray head 1 which is made according to one of the embodiments and teaching of the present invention, as detailed above, sits on the fluid container 2.

We claim:

1. A spray head for an aerosol tank which is closed by a fluid exit valve including one of a female fluid exit valve and a male fluid exit valve, used for spraying a fluid from the aerosol tank, the fluid exit valve defining an axial fluid exit direction, the spray head comprising:

a bottom part;

a top part having an exposed actuating surface on the outside thereof for actuating/opening the fluid exit valve when the spray head is seated on the aerosol tank, a receiving space for receiving and holding said bottom part, and a base part for seating on a rim of the aerosol tank;

a capillary tube for routing the fluid and for nozzle-less spraying of the fluid, said capillary tube having an axially open entry end within said spray head and an axially open exit end within said spray head, said entry end of the capillary tube being arranged so as to be axially joinable to the fluid exit valve when the spray head is seated on the aerosol tank, said exit end of the capillary tube being open to ambient atmosphere, at least said top part being formed with an arcuate guide surface for said capillary tube running approximately in an arc of approximately 90° from the entry end to the exit end in the spray head, the spray head having an exit opening from which fluid sprayed from the exit end of the capillary tube is able to emerge undisturbed;

at least one of a valve tappet and a valve receiver, formed as part of at least one of said top and bottom parts of the spray head, for, respectively, fluidically connecting to one of a receiver of the female fluid exit valve and a valve tappet of the male fluid exit valve such that both parts are moveable together by said exposed actuating surface to operate the valve when the spray head is seated on the aerosol tank, the entry end of said capillary tube extending into said at least one of the valve tappet and the receiver for receiving fluid from said one of the receiver of the female fluid exit valve and the valve tappet of the male fluid exit valve when the spray head is seated on the aerosol tank, wherein said at least one of the valve tappet and the receiver has an exposed end directed from within the spray head toward the open end of the bottom part of the spray head.

2. The spray head of claim 1, wherein the spray head is formed of plastic material.

3. The spray head of claim 1, wherein the capillary tube is formed of a metal material.

4. The spray head of claim 1, wherein an inside diameter of the capillary tube is between approximately 0.1 mm and approximately 2.0 mm and a length of the capillary tube is approximately 10 mm to approximately 100 mm.

5. The spray head of claim 4, wherein the inside diameter is between approximately 0.2 mm and approximately 1.0 mm and the length of the capillary tube is approximately 25 mm to approximately 50 mm.

6. The spray head of claim 1, wherein the guide surface of the top part of spray head comprises an outside guide and the bottom part includes an inside guide corresponding to a desired course of the arc of the capillary tube, the arc of the capillary tube being guided by the outside guide and the inside guide.

7. The spray head of claim 6, wherein the outside guide and the inside guide are connected to one another into a closed channel and the capillary tube is positioned in the channel.

8. The spray head of claim 6, wherein top and bottom parts of the spray head are each made in the manner of a half-shell and are joined to one another for common formation of the outside guide and the inside guide.

9. The spray head of claim 8, wherein the parts are at least one of cemented, clipped, welded, locked, mortised and screwed together.

* * * * *